US006141907A

United States Patent [19]

Parazader

[11] Patent Number: 6,141,907

[45] Date of Patent: Nov. 7, 2000

[54] BIPARTING PANEL ASSEMBLY

[76] Inventor: Stephen Parazader, 44 Oak Avenue, Dundas, Ontario, Canada, L9H 4Y9

[21] Appl. No.: 09/076,457

[22] Filed: May 12, 1998

[51] Int. Cl.[7] ..... E05C 7/06

[52] U.S. Cl. ..... 49/121; 49/125; 49/120

[58] Field of Search ..... 49/116–123, 366, 49/372, 127, 138, 409, 410, 411, 425; 52/67, 472, 632; 160/118, 222; 16/97, 98, 103

[56] References Cited

U.S. PATENT DOCUMENTS

| | | | |
|---|---|---|---|
| 736,357 | 8/1903 | Brousseau | 160/118 |
| 756,524 | 4/1904 | Rashkin | 49/128 |
| 1,295,561 | 2/1919 | Moore | 160/118 |
| 1,697,685 | 1/1929 | Grant | 49/127 |
| 1,810,496 | 6/1931 | Peelle | 49/118 |
| 1,836,059 | 12/1931 | Bancroft | 49/118 |
| 1,872,175 | 8/1932 | Peelle | 49/118 |
| 1,943,042 | 1/1934 | Schweig | 49/118 |
| 2,174,524 | 10/1939 | Nisbet | 160/118 |
| 2,841,390 | 7/1958 | Urquhart | 49/118 |
| 2,937,867 | 5/1960 | Schweig | 49/118 |
| 3,452,477 | 7/1969 | Sassano | 49/116 |
| 5,598,665 | 2/1997 | Guddas | 49/411 |
| 5,829,504 | 11/1998 | Ekstrand et al. | 49/197 |

*Primary Examiner*—Daniel P. Stodola
*Assistant Examiner*—Curtis A. Cohen

[57] ABSTRACT

A panel assembly comprises first and second bi-parting panel groups. Each group has at least a first and a second panel movable between a retracted and an extended position for opening and closing the panel assembly. The second panel in each group travels farther than and across the first panel in each group when the panels move between their retracted and extended positions.

10 Claims, 8 Drawing Sheets

BIPARTING PANEL ASSEMBLY

FIELD OF THE INVENTION

The present invention relates in general to a panel assembly comprising first and second groups of bi-parting panels.

BACKGROUND OF THE INVENTION

According to known bi-parting panel constructions, two panels are mounted vertically aligned with one another. The panels are secured by a cable which wraps around a pulley in a manner such that as the top panel is lifted, the bottom panel drops downwardly to expose an opening behind the two panels. The opening is closed by pulling down on the top panel which in turn pulls the bottom panel upwardly.

The benefit of such a system is that the two panels can be of substantially the same weight so that they are counter-balanced thereby requiring very little effort to open and close the assembly.

To date, bi-parting panel assemblies have only used two panels which either limits the size of the opening covered by the panels or in the alternative, requires very substantial panel sizes to cover a large opening and large storage space into which the panels must move for exposing the opening.

Glazing systems and in particular sloped glazing systems could well benefit through the use of a bi-parting panel concept. However, for the reasons given above, bi-parting panels have not been used in glazing systems other than for very small openings. Furthermore, known bi-parting panel constructions would not seem to be practical for use in a glazing system because this would require extremely large individual glazing panels which as known in the glazing art, presents substantial difficulties from an integrity standpoint.

SUMMARY OF THE INVENTION

The present invention relates to a panel assembly of the bi-parting type having a plurality of panels to opposite sides of center of the assembly. This enables the use of smaller panels than has been possible in the prior art constructions which have only a single panel to each side of center. Accordingly, the assembly of the present invention is particularly suitable in a glazing system capable of moving across a large opening.

More specifically, the panel assembly of the present invention comprises first and second bi-parting panel groups with each panel group having at least a first and a second panel. Each panel in the assembly is movable between a retracted and an extended position for opening and closing the panel assembly. The second panel in each group travels farther than and across the first panel in each group when the panels move between their retracted and extended positions. The second panel in the first group meets with the second panel in the second group when all of the panels are in their extended positions and the second panel lies side by side aligned with the first panel in each group when all of the panels are in their retracted positions.

The first panel in the first panel group is attached by a first cable around a first pulley to the first panel in the second panel group and the second panel in the first panel group is attached by a second cable around a second pulley to the second panel in the second panel group. Both of the pulleys are journalled on a common drive shaft to produce simultaneous movement of all of the panels. The second pulley is of a diameter larger than that of and of a ratio relative to the first pulley such that all of the panels reach their respective retracted and extended positions coincidentally with one another.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
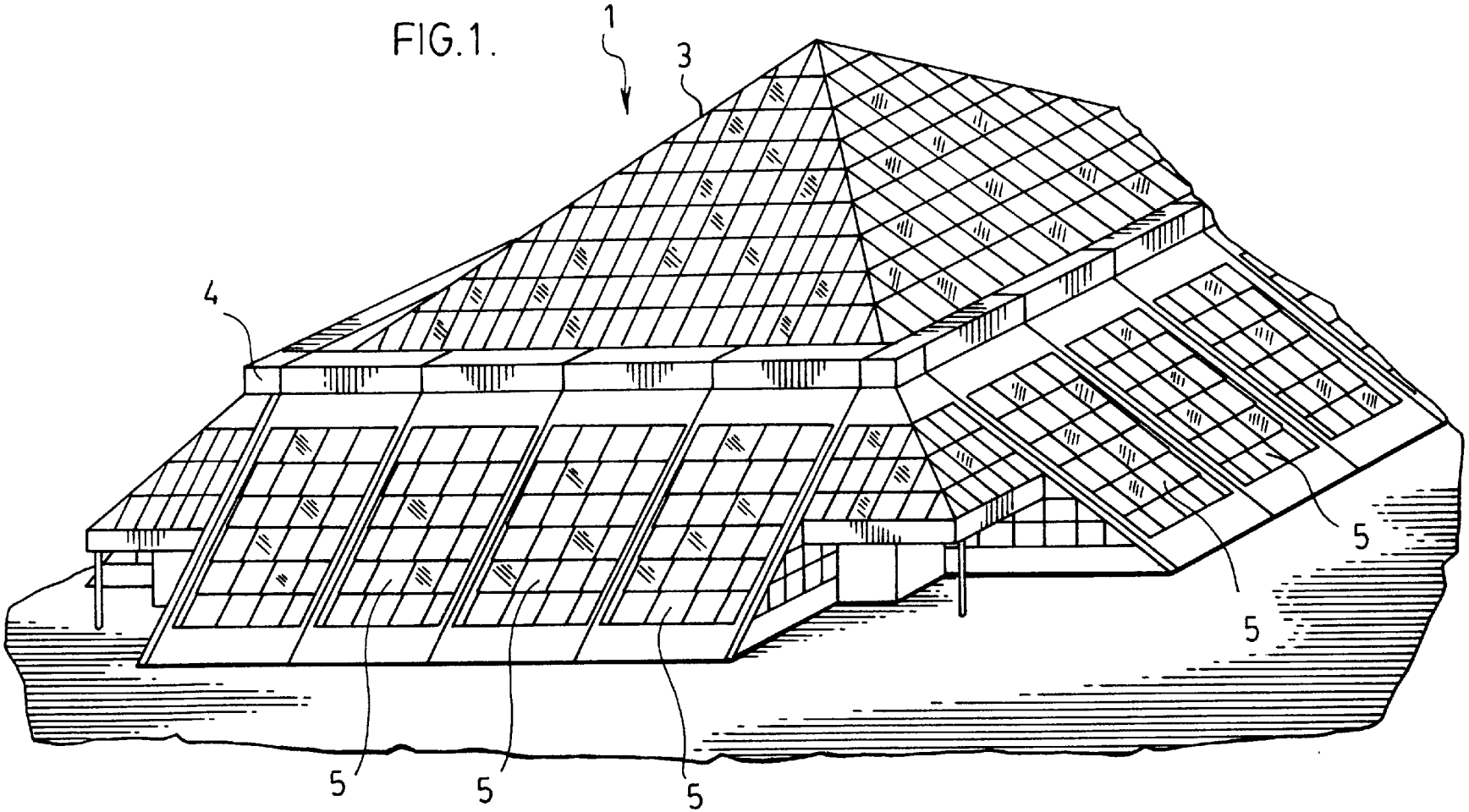
FIG. 1 is a perspective view of a building structure incorporating a series of bi-parting panel assemblies according to a preferred embodiment of the present invention.

FIG. 1 shows a building structure generally indicated at 1. This building structure has an upper roof portion 3 which is supported by a roof ring or frame 4. Frame 4 is held in position by vertical supports provided directly beneath the frame.

Roof part 3 can take many different forms. For example, it can be a fixed or a movable roof part. Furthermore, it can be made of opaque or transparent materials.

The building construction further includes a sloped portion beneath frame 4 to ground level around its perimeter. This sloped portion can be set at different acute angles and preferably is at an angle of something between 45° and 60°. At these angles the sloped portion is considered to be a further roof portion beneath the upper roof portion 3.

In the event that the sloped portion is replaced with a vertical portion, then such a vertical portion would be referred to as a wall for the building.

In the preferred embodiment as shown the sloped portion comprises a plurality of panel assemblies generally indicated at 5. These panel assemblies are side by side with one another on each exterior side of the building construction.

Again, in the preferred embodiment as shown, panel assemblies 5 are formed from a plurality of glazed panels as to be described later in detail. Therefore, the entire building construction is surrounded by a sloped glazing system. This sloped glazing system can be used to cover small patio like enclosures which can be built separately from and then added to the main enclosure of the building.

Figure 2:
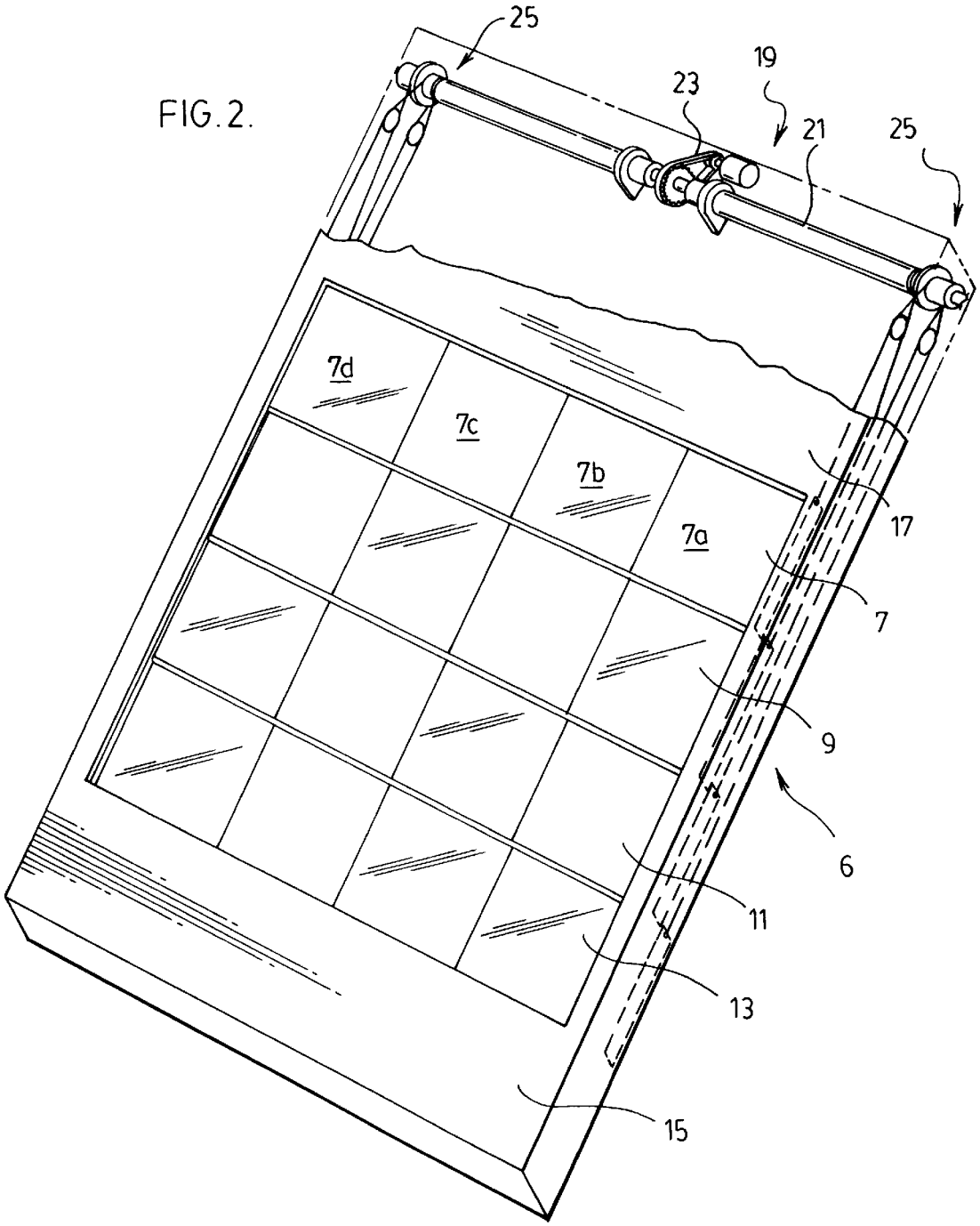
FIG. 2 is a perspective view of one of the bi-parting panel assemblies from the building construction of FIG. 1.
Figure 3:
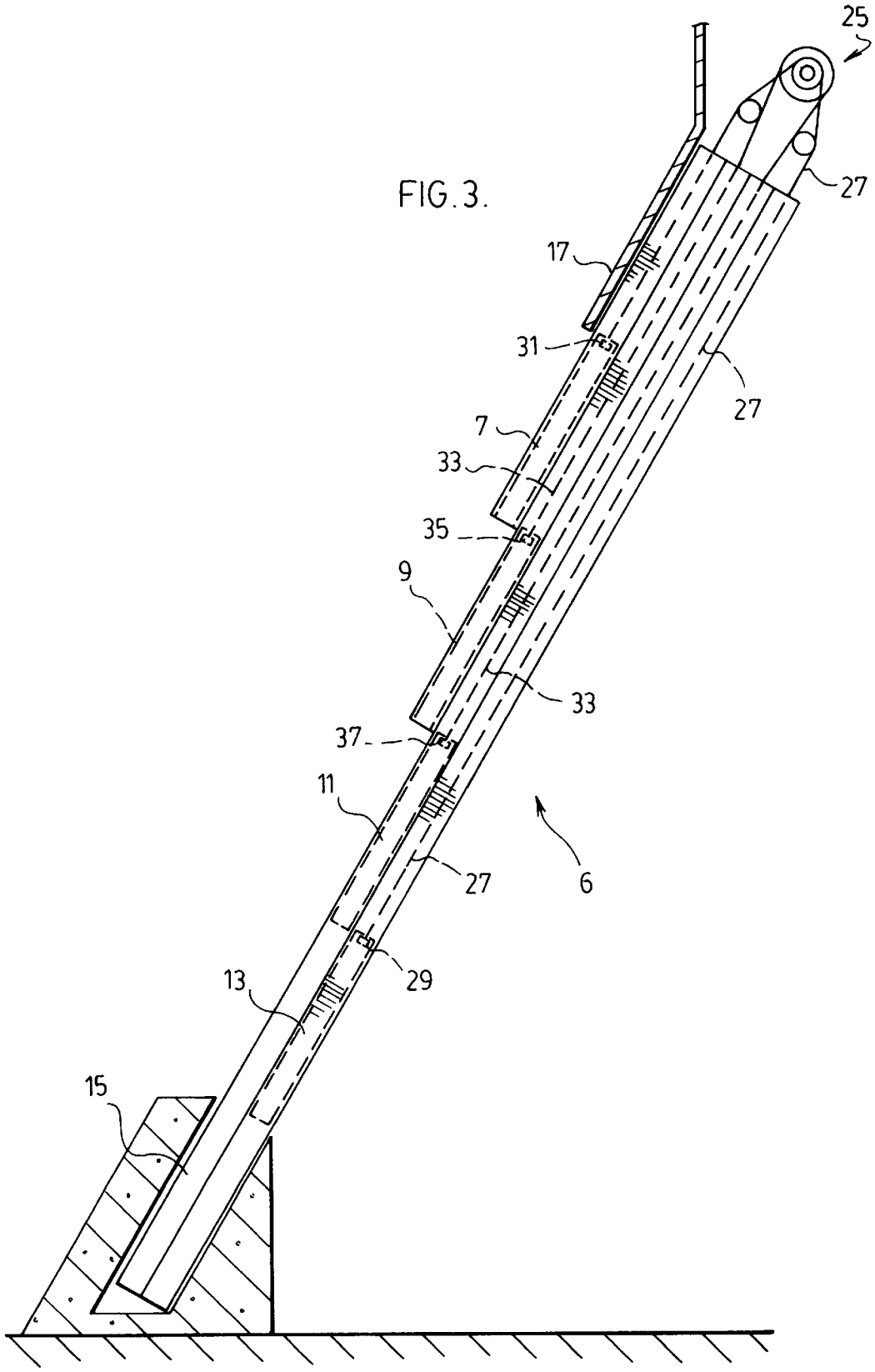
FIGS. 3 and 4 are side views of a preferred embodiment panel assembly respectively in the closed and the opened positions.
Figure 4:
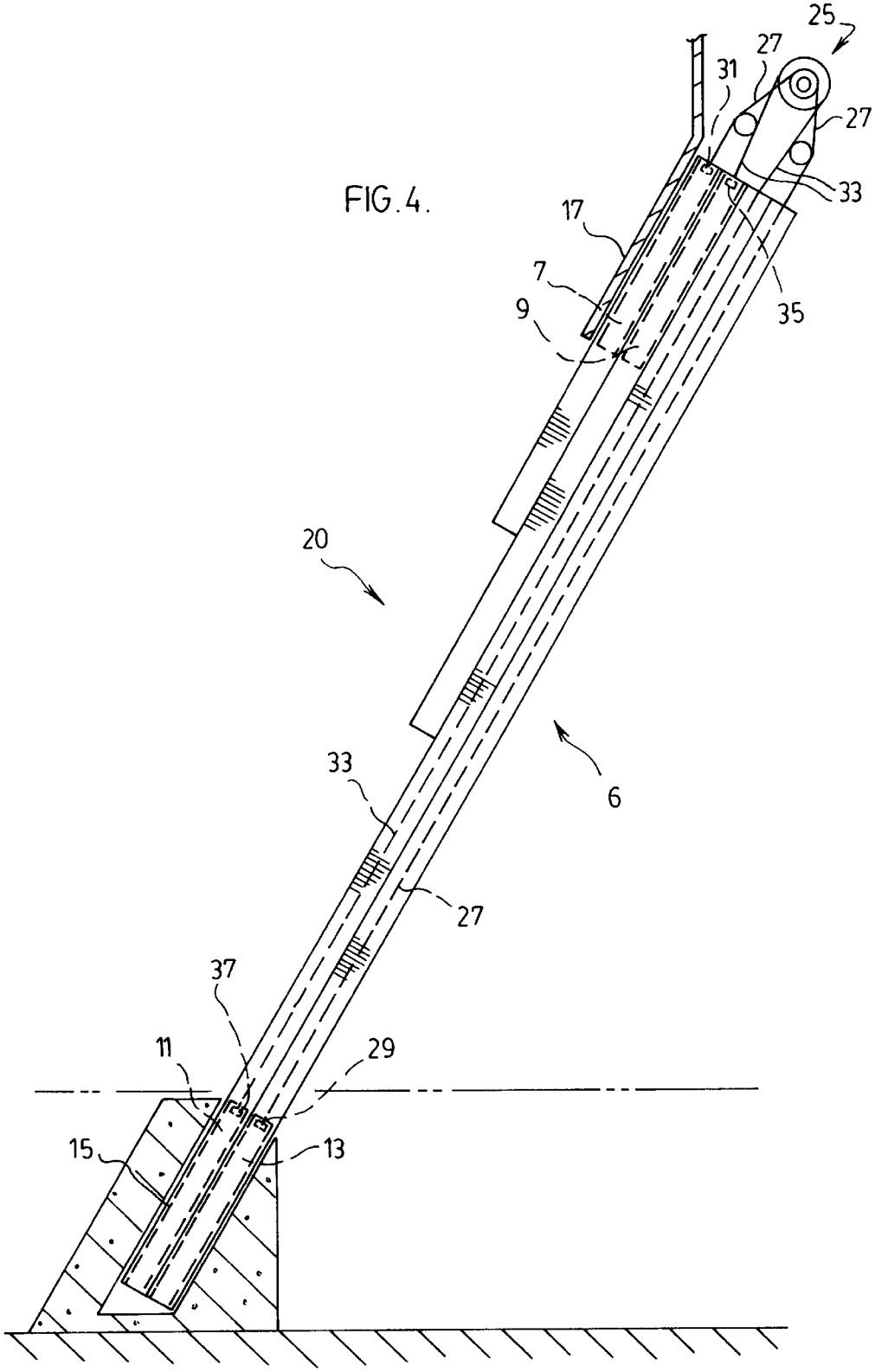

Before getting into the details with respect to the actual construction of each panel, it should be noted having particular reference to FIGS. 2 through 4 of the drawings that each panel is movable between an extended position in which each panel assembly is closed to a retracted position for the opening of each panel assembly.

More particularly, FIGS. 2 through 4 show a panel assembly generally indicated at 6 which is the same as panel assembly 5 except that panel assembly 6 includes fewer movable panels.

As best seen in FIG. 2, panel assembly 6 comprises panels 7, 9, 11 and 13. Each of these panels has a grid-like construction formed from a plurality of sub-panels 7*a* through 7*d*. These sub-panels are all integrated with one another such that panel 7 moves as a single unit. The same is true with respect to panels 9, 11 and 13.

FIG. 2 shows all of the panels in their extended positions where the panel assembly is closed over the enclosure beneath the panel assembly.

In order to open the assembly panels 7 and 9 move as a first panel group upwardly to a retracted position where they are hidden internally of a hollow frame part 17 of the assembly. Panels 11 and 13 on the other hand, move downwardly to a retracted position where they are hidden internally of a hollow frame part 15 of the assembly. The upward movement of panels 7 and 9 automatically produces the downward movement of panels 11 and 13. This is because the two groups of panels are connected to one another and operate in a bi-parting fashion. Accordingly, movement of panels 7 and 9 downwardly back to their extended positions produces simultaneous upward movement of panels 11 and 13 back to their extended positions.

All of the panels are of substantially identical size and weight such that the panels counterbalance one another. Therefore, the force required to lift panels 7 and 9 upwardly to their retracted positions, is offset by the downward moving weight of panels 11 and 13. The only force that needs to be overcome is the friction within the assembly.

The counterbalancing effects are the same for lifting panels 11 and 13 upwardly to their extended positions which is offset by the downwardly moving weight of panels 7 and 9 as they drop down to their extended positions.

Although the system of the present invention incorporates the concept of bi-parting panels, the actual operation of the panels is different from anything found in the past and is unique to the present invention. This is because of the use of a plurality of panels to either side of center of the bi-parting system.

FIGS. 3 and 4 show why the panel assembly is different from prior art constructions. More particularly, FIG. 3, like FIG. 2 shows each of the panels in their extended closed positions. FIG. 3 additionally shows that the panels are set up in a stepped pattern where, for example, panel 7 is located above and stepped outwardly relative to panel 9. Panel 9 is above and stepped outwardly relative to panel 11 and panel 11 is above and stepped outwardly relative to panel 13. This stepping of the panels enables them to move to their retracted positions as shown in FIG. 4 of the drawings where panels 7 and 9 lie side by side aligned with one another hidden within frame portion 17 with panels 11 and 13 doing the same thing in frame portion 15. This creates a large opening generally indicated at 20 between frame portions 15 and 17. However, the storage spaces for the panels, i. e. frame portions 15 and 17 are only a quarter rather than a half the size of the opening because of the collapsing nature of each of the panel groups. This is to be contrasted to a conventional biparting panel system requiring much larger storage space for the panels.

As noted above, the only difference between the panel assembly 5 of the FIG. 1 and panel assembly 6 of FIG. 2 is the number of panels in each assembly. However, in each case, and in any other panel assembly, covered by the present invention, each panel group to opposite sides of the assembly includes the same number of panels. Furthermore, and according to a unique feature of the present invention, there is simultaneous movement of all of the panels with some of the panels moving faster than others so that all of the panels reach their respective retracted and extended positions coincidentally with one another. This is achieved through a unique drive system generally indicated at 19 and well shown in FIGS. 2 through 5 of the drawings.

Drive system 19 comprising a drive shaft 21 extending across the upper end of the assembly hidden within the assembly frame. This drive shaft can be manually operated or operated by a motorized drive system generally indicated at 23. As noted above, manual operation of this system is extremely easy because of the counter-weighting of the upper and lower groups of panels.

Figure 5:
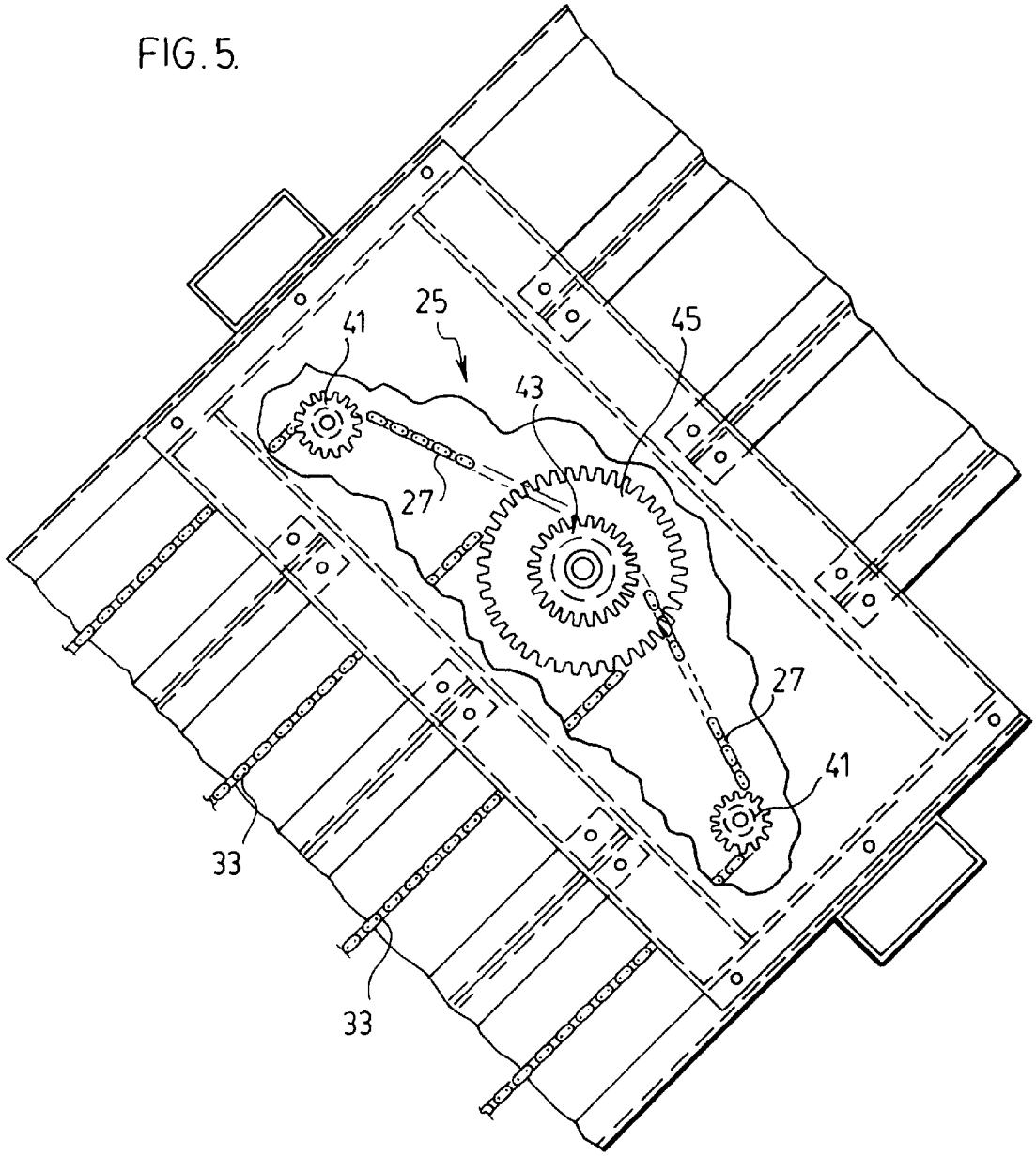
FIG. 5 is a side view of the gearing system used to operate the panel assembly of FIG. 2.

Located at each end of shaft 21 is a pulley assembly generally indicated at 25. This pulley assembly as best seen in FIG. 5 comprises a pair of gears 41 located off of the drive shaft and a further pair of gears 43 and 45 journalled on the drive shaft. A chain 27 engages with and is driven by gear 43. This chain also engages gears 41 which are nothing more than follower or idler gears directing chain 27 onto gear 43.

A second chain 33 engages with and is driven by gear 45.

As seen for example in FIG. 3 of the drawings, chain 27 secures at attachment point 31 to the upper end of panel 7 and after wrapping around pulley assembly 25 secures at attachment point 29 of panel 13. Chain 33 secures at attachment point 35 to the upper end of panel 9 and after wrapping around the pulley assembly secures at attachment point 37 to the upper end of panel 11. Accordingly, panel 7 is chain linked around the pulley assembly to panel 13 while panel 9 is chain linked around the pulley assembly to panel 11.

As seen in FIG. 2, the chain linking of the panels with one another is provided to both sides of the panel assembly to ensure a smooth torque resistant non-binding operation of the assembly which occurs as follows.

Rotation of drive shaft 21 produces rotation of drive gears 43 and 45 at the opposite ends of the drive shaft. In this case, because all of the panels are of the same size, panels 9 and 11 have to move twice as far as panels 7 and 13 between their retracted and extended positions. Accordingly, drive gear 45 has a diameter twice that of drive gear 43. This causes panels 9 and 11 to move twice as fast as panels 7 and 13 during any movement of the system such that all of the panels simultaneously reach their fully retracted or fully extended positions. Furthermore, because of the stepping of the panels relative to one another panel 9 moves across panel 7 while panel 11 moves across panel 13 with the opening and the closing of the assembly.

Each of the panels is supported on its opposite sides by a track having a track region specific for each panel. The panels are provided with rollers that move within these tracks. The chains between the panels are also located within the tracks.

Figure 6:
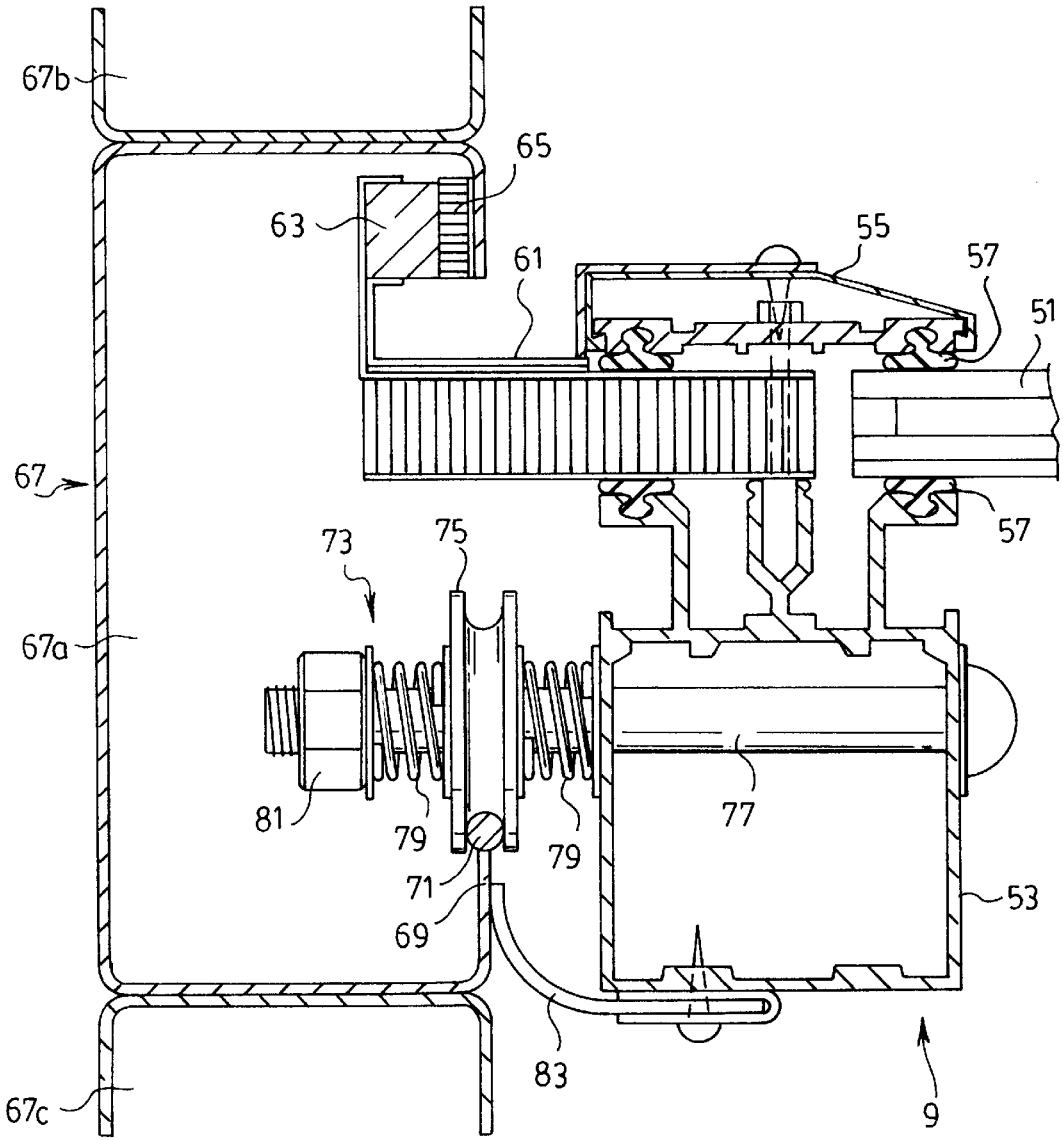
FIG. 6 is a sectional view through the track of a roller system used for moving the panels in accordance with one preferred embodiment of the present invention.

One particular track and roller system is shown in FIG. 6 of the drawings. This figure also shows a frame and glazing unit for a preferred embodiment panel construction.

More specifically, panel 9, which has the same construction as panels 7, 11 and 13, comprises a glazing portion 51 secured by a support frame formed by frame portions 53 and 55 to opposite sides of the glazing. Frame portion 53 and 55 are provided with seals 57 which clamp on the glazing and the two frame portions are secured to one another through a thermal break connection.

Part of the frame projects into track portion 67*a* of an overall track 67. As will be seen, track portions 67*b* and 67*c* are located to either side of track portion 67*a*. Panel 7 will travel in track portion 67*b* while panel 11 will travel within track portion 67*c*. A further track portion which cannot be seen in FIG. 6 is provided to the opposite side of track portion 67*c* to guide movement of panel 13.

Track portion 67*a* includes a base leg 69 provided with a track rod 71. This track rod is preferably made from stainless steel or some other high strength non-corroding material.

Frame portion 53 of the panel includes a bolt 77 which extends into track portion 67*a*. A flanged wheel 75 is rotatably mounted on bolt 77. This flanged wheel rides along rod 71 to guide the movement of the panel.

A pair of springs 79 are provided to either side of the flanged wheel with the springs and the flanged wheel being secured by a nut 81 to bolt 77. Flanged wheel 75 can either shift to the right or the left along bolt 77 to allow panel deflection caused, for example, by wind load. The springs 79 return the flanged wheel to its centered position when the panel is not under load.

In order to seal the roller assembly and keep it clean from outside debris, a flexible seal 83 is provided on frame portion 53. This flexible seal, as seen in FIG. 6, rides along the track leg 69. In addition, the upper frame portion 55 is provided with a right angle leg 61 which carries a sealing element 63 which runs along a further sealing element 65 secured directly to the track. Again, according to the preferred embodiment construction, sealing element 63 is in the form of a felt strip continuously along the panel frame while sealing element 65 is a vinyl strip continuously along the track.

Figure 7:
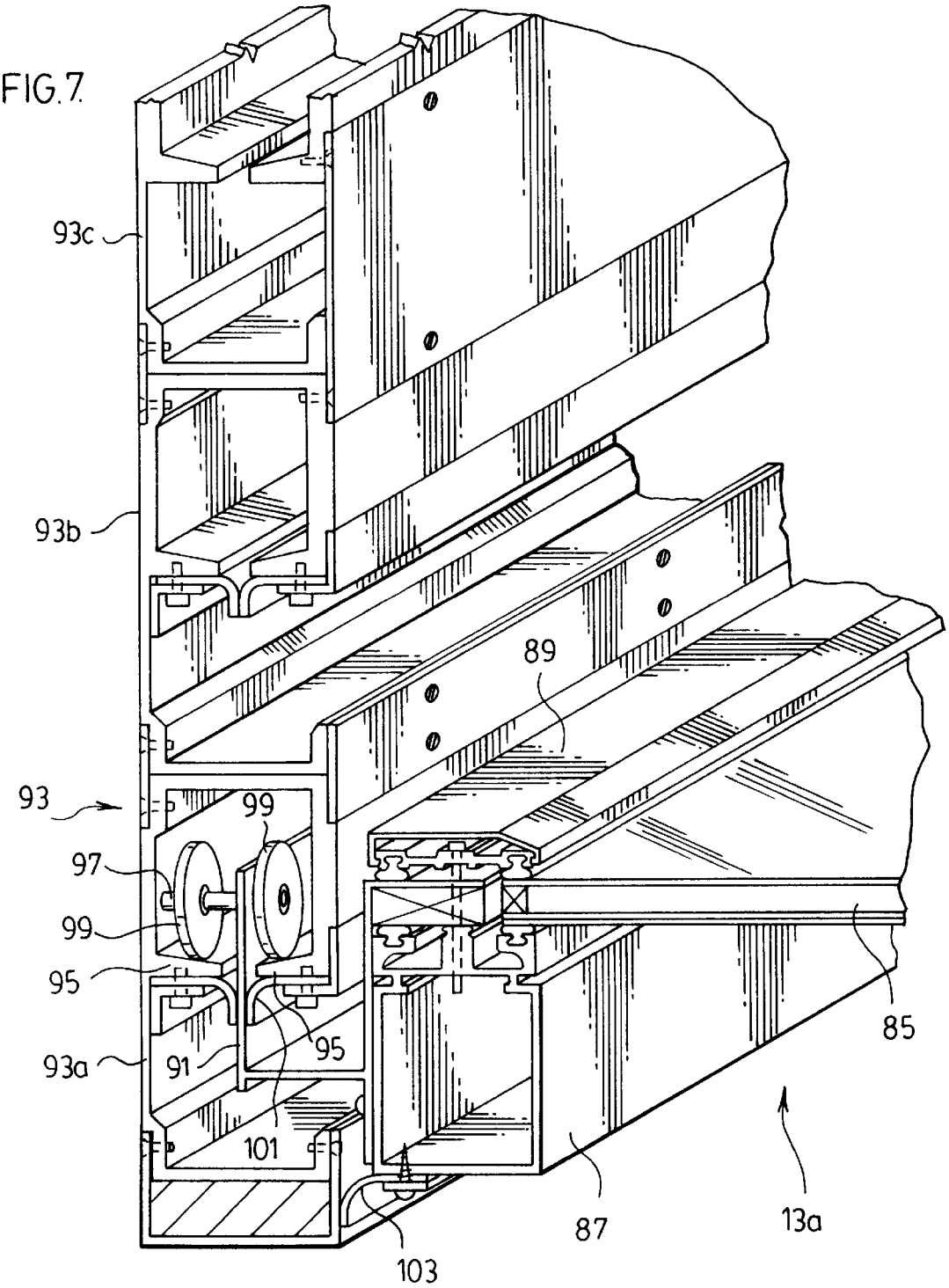
FIG. 7 shows an alternate roller system according to yet a further preferred embodiment of the present invention.

FIG. 7 shows another panel roller and track construction. In particular, a panel 13*a* comprises a glazing portion 85 bordered by a frame comprising frame portions 87 and 89 secured to one another on opposite sides of the glazing portion by a thermal break connection.

Frame portion 87 of the panel includes a right angle arm 91 which extends into a track portion 93*a* of a track 93. In this case, it will be seen that track portions 93*b* and 93*c* are provided above track portion 93*a* to receive the roller assemblies of further panels.

Track portion 93*a* includes a pair of base walls 95 separated by a gap through which arm 91 is fitted. The arm carries a pair of roller wheels 99 secured to the arm by an axle 97. Like the embodiment of FIG. 6, springs are also provided on axle 97 to accommodate for shifting of the panel through wind load etc. As an additional feature, to prevent binding of the roller wheels and to assist in centering and maintaining the wheels in an upright position, the walls 95 of the track along which the wheels roll are sloped downwardly towards the center opening between the walls.

In order to keep the track clear of debris, which might otherwise adversely affect the performance of the roller system, a pair of flexible wiper seals 101 are provided to either side of arm 91 and a further flexible wiper seal 103 is provided on the base of frame portion 87 against the track portion 93*a*.

As is to be understood, the roller and track assembly of FIG. 6 or the roller and track assembly of FIG. 7 is provided to either side of each of the movable panels.

Figure 8:
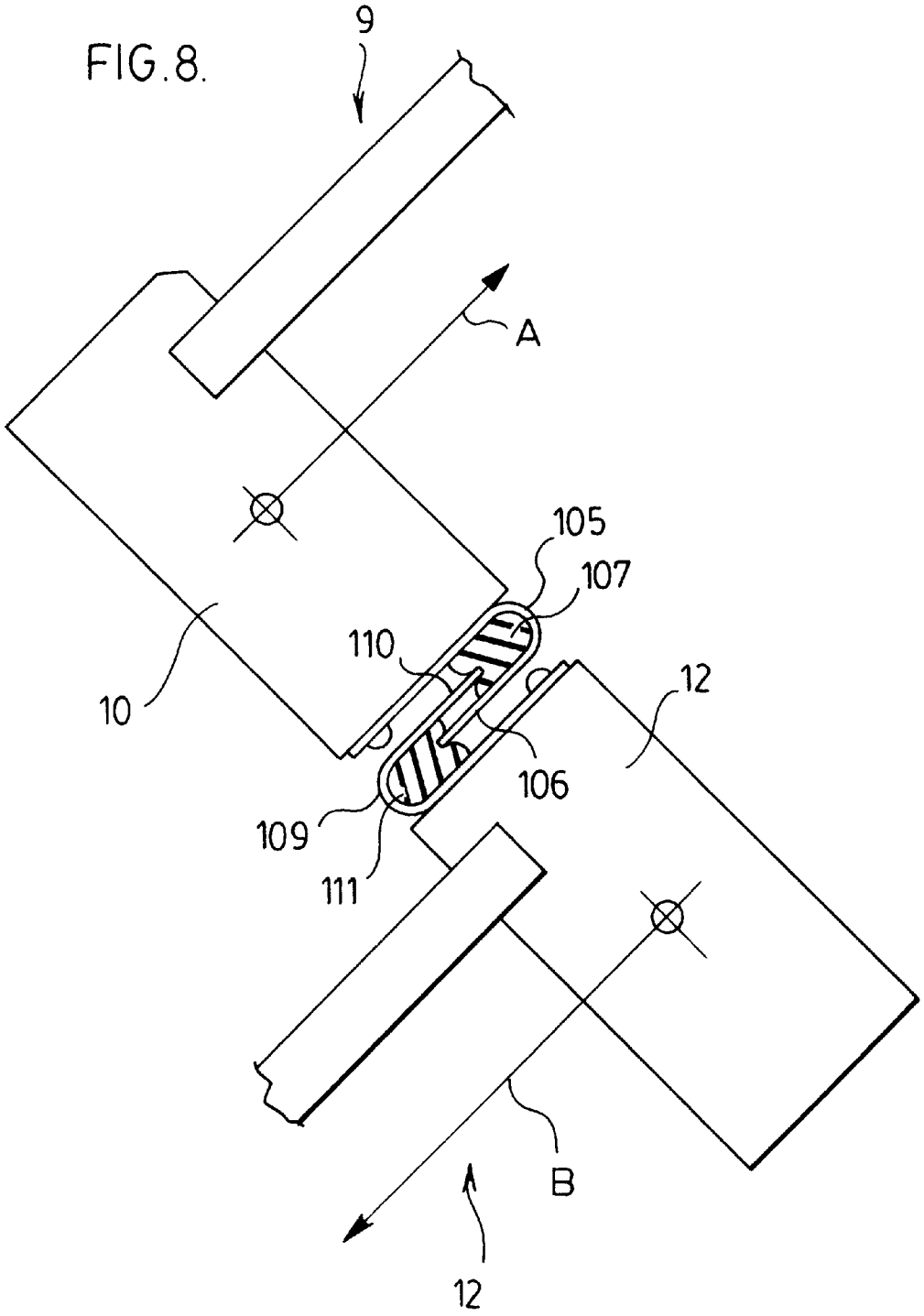
FIG. 8 is a sectional view through two of the panels from the assembly of FIG. 2 where they close with one another.

When all of the panels move to their extended positions, they seal against one another to prevent both air and moisture movement past the panel assembly. FIG. 8 shows a particularly good sealing system between adjacent panels.

In the sealing system of FIG. 8, frame portion 10, which is the leading or bottom edge of panel 9, is provided with a U-shaped bracket 105 containing flexible sealing material 107. Frame portion 12, which is provided at the upper or leading edge of panel 11 is provided with U-shaped bracket 109 containing flexible sealing material 111.

As shown in FIG. 8, frame portion 10 of panel 9 moves to an extended position where it lies directly above frame portion 12 of panel 11. The free edge 106 of bracket 105 embeds itself in sealing material 113 of bracket 109. The free edge 110 of bracket 109 in turn, embeds itself in the sealing material 107 contained within bracket 105. This provides a double interlock seal which, as noted above, stops the movement of both air and moisture past the two panels.

As will be understood from FIG. 8, panel 9 is allowed to move upwardly in the direction of arrow A while panel 11 is allowed to move downwardly in the direction of arrow B away from their extended sealed positions to their retracted positions without any interference from the double seal interlock.

Similar sealing arrangements are provided between each of the panels in each panel group. For example, the trailing edge of panel 9 will be provided with the same type of seal to engage the leading edge of panel 7 while the trailing edge of panel 11 will be provided with the same type of seal to engage the leading edge of panel 13.

Although the description above relates specifically to sloped glazing systems, it is to be appreciated that the general concept of bi-parting panel groups can equally as well be used with vertically or horizontally extending panels. Furthermore, the concept can be used with solid as well as glazed panels.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A panel assembly comprising first and second panel groups, each panel group having at least a first and a second panel, each panel in said assembly being movable between a retracted and an extended position for opening and closing said panel assembly, said first panel group being located above said second panel group, the panels in said first panel group travelling downwardly and upwardly when moving respectively to their extended and retracted positions, the panels in said second panel group travelling upwardly and downwardly when moving respectively to their extended and retracted positions, all of said panels being of at least substantially identical weight such that said assembly is counterbalanced between said first and second panel groups, the panels being laterally offset in a manner such that when the panels reach their extended positions there is a consistent downward inward stepping of the panels over an opening to be closed by the panels, the second panel travelling further than and vertically across the first panel in each group when the panels move between their retracted and extended positions, the second panel in the first group meeting with the second panel in the second group when all the panels are in their extended positions and the second panel lying side by side aligned with the first panel in each group when all of the panels are in their retracted positions, the first panel in the first panel group being attached by a first chain around a first sprocket gear to the first panel in the second panel group and the second panel in the first panel group being attached by a second chain around a second sprocket gear to the second panel in the second panel group, both the first and second sprocket gears being journalled on a common drive shaft to produce simultaneous movement of all of said panels, said second sprocket gear being larger than and of a ratio relative to said first sprocket gear such that all of said panels reach their respective retracted and extended positions coincidentally with one another.

2. A panel assembly as claimed in claim 1, wherein said panels are inclined at an angle between horizontal and vertical.

3. A panel assembly as claimed in claim 1, including a support frame for said panels, said support frame including a plurality of guide tracks, one on each side of each panel, each panel having rollers to opposite sides thereof trapped in the guide tracks for each panel.

4. A panel assembly as claimed in claim 3, wherein said panels are suspended from the guide tracks by the rollers, each track having a base with a slot therethrough and base walls to either side of said slot, said base walls being sloped downwardly towards the slot, each roller comprising a pair of roller wheels, one on each of said base walls.

5. A panel assembly as claimed in claim 4, including a connector arm from the support frame to the roller for each panel, the connector arm being fitted through the slot in the base of each track, and each track having a wiper seal beneath the base thereof, said wiper seal being pressed against opposite sides of the connector arm at each track.

6. A panel assembly as claimed in claim 5, wherein the roller wheels of each roller are mounted on a roller axle fitted through the connector arm, the wheels being spaced from one another on opposite sides of the connector arm with a spring between each roller wheel and the connector arm.

7. A panel assembly as claimed in claim 3, wherein said roller comprises a flanged wheel mounted on an axle extending from the frame portion into the track on either side of each panel, said frame portion including a sealing member which moves with each frame portion interiorly along the track above and sealing the flanged wheel within the track at each side of each panel.

8. A panel assembly as claimed in claim 7, wherein said wheel is spring loaded on said axle.

9. A panel assembly as claimed in claim 1, including edge seals on each panel, the edge seals from panel to panel engaging one another when the panels are in their extended positions.

10. A panel assembly as claimed in claim 9, wherein the edge seal of one of said panels interlocks with the edge seal of another one of said panels to form a double interlock compression seal.

* * * * *